US009080365B2

(12) United States Patent
Collene et al.

(10) Patent No.: US 9,080,365 B2
(45) Date of Patent: Jul. 14, 2015

(54) APPLIANCE LID HINGE ASSEMBLY

(71) Applicant: Mansfield Engineered Components, Inc., Mansfield, OH (US)

(72) Inventors: James J. Collene, Bucyrus, OH (US); Nicholas R. SirLouis, Seville, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

(21) Appl. No.: 14/085,110

(22) Filed: Nov. 20, 2013

(65) Prior Publication Data

US 2014/0150212 A1 Jun. 5, 2014

Related U.S. Application Data

(60) Provisional application No. 61/728,336, filed on Nov. 20, 2012.

(51) Int. Cl.

| | |
|---|---|
| ***E05F 1/08*** | (2006.01) |
| ***E05F 1/12*** | (2006.01) |
| ***E05F 5/02*** | (2006.01) |

(52) U.S. Cl.

CPC ..... *E05F 1/1261* (2013.01); *E05F 5/02* (2013.01); *E05Y 2201/21* (2013.01); *E05Y 2201/264* (2013.01); *E05Y 2201/638* (2013.01); *E05Y 2900/30* (2013.01); *Y10T 16/52* (2015.01); *Y10T 16/5383* (2015.01)

(58) Field of Classification Search

CPC ..... E05F 1/1246; E05F 1/1253; E05F 1/1261; E05F 1/1292; E05F 1/14; E05F 1/12; E05F 3/20; E05Y 2201/21; E05Y 2201/264; E05Y 2201/416; E05Y 2201/47; E05Y 2201/471; E05Y 2900/20; E05Y 2900/30; E05Y 2900/302; E05Y 2900/304; E05Y 2900/306; E05Y 2900/308; E05Y 2900/31; E05Y 2900/312

USPC ..... 16/286, 289, 290, 292, 321, 322, 306; 49/386, 387, 389, 398, 402; 126/190, 126/191, 192, 194; 312/323, 325, 326, 327

See application file for complete search history.

(56) References Cited

U.S. PATENT DOCUMENTS

| | | | | |
|---|---|---|---|---|
| 1,634,358 A | | 7/1927 | Hobson | |
| 2,173,422 A | | 9/1939 | Lucas | |
| 3,457,584 A | * | 7/1969 | Phelps | 16/290 |

(Continued)

FOREIGN PATENT DOCUMENTS

| | | | |
|---|---|---|---|
| DE | 4105274 A | * | 11/1991 |
| DE | 19538824 A1 | * | 5/1996 |

(Continued)

*Primary Examiner* — Chuck Mah

(74) *Attorney, Agent, or Firm* — Fay Sharpe LLP

(57) ABSTRACT

An appliance lid hinge assembly has a channel housing including first and second spaced-apart side walls and a transverse face walls, a cavity located between the first and second side walls and a slot having first and second slot portions respectively located in said first and second side walls. The channel housing is pivotally connected to a cam via a rivet or other pivot fastener at a pivot point. A biasing element acts between the housing and the cam in order to control the movement of housing relative to the cam about the pivot point. Alternatively, a damper can be used to control movement of the housing relative to the cam about the pivot point. A snubber subsystem can also be added to provide further damping resistance.

16 Claims, 16 Drawing Sheets

(56) References Cited

U.S. PATENT DOCUMENTS

| | | | | |
|---|---|---|---|---|
| 3,749,080 | A | 7/1973 | Kleinhenn | |
| 4,163,344 | A * | 8/1979 | Scherer | 49/386 |
| 4,194,321 | A * | 3/1980 | Hess | 49/389 |
| 4,269,165 | A | 5/1981 | Wrotny et al. | |
| 4,294,226 | A * | 10/1981 | Feinberg | 126/286 |
| 4,658,473 | A | 4/1987 | Schema | |
| 5,289,615 | A * | 3/1994 | Banks et al. | 16/366 |
| 6,397,836 | B1 | 6/2002 | Pelletier et al. | |
| 6,442,799 | B1 | 9/2002 | Duarte et al. | |
| 6,637,319 | B1 | 10/2003 | Vanini et al. | |
| 6,789,293 | B2 * | 9/2004 | Habegger et al. | 16/343 |
| 7,243,396 | B2 | 7/2007 | Vanini | |
| 7,676,888 | B2 * | 3/2010 | Vanini | 16/286 |
| 8,443,489 | B2 | 5/2013 | Sir Louis | |
| 2005/0081721 | A1 * | 4/2005 | Craycraft et al. | 99/450 |
| 2006/0032019 | A1 | 2/2006 | Kistner et al. | |
| 2006/0053589 | A1 | 3/2006 | Vanini | |
| 2009/0064458 | A1 | 3/2009 | Vanini | |
| 2010/0148646 | A1 * | 6/2010 | Bettinzoli | 312/326 |
| 2010/0281650 | A1 * | 11/2010 | Kleemann et al. | 16/64 |
| 2011/0146654 | A1 | 6/2011 | Mudbasal et al. | |

FOREIGN PATENT DOCUMENTS

| | | |
|---|---|---|
| EP | 0 149 937 | 12/1984 |
| EP | 589853 A1 * | 3/1994 |

* cited by examiner

APPLIANCE LID HINGE ASSEMBLY

CLAIM OF PRIORITY

This application claims priority from and benefit of the filing date of U.S. Provisional Application Ser. No. 61/728,336, filed Nov. 20, 2012, and the entire disclosure of said provisional application is hereby expressly incorporated by reference into the present specification.

BACKGROUND OF THE DISCLOSURE

Hinge assemblies for top-loading appliance lids or doors are known to include a damper such as a pneumatic or hydraulic damper with a selectively extendable and retractable rod pivotally connected to a first component of the hinge assembly and a body pivotally connected to a second component of the hinge assembly such that the damper rod is extended and retracted in response to pivoting movement of the first and second hinge assembly components relative to each other.

These known hinge assemblies can be effective, durable, and otherwise exhibit desired performance characteristics, but the dampers are often large, heavy, expensive, and can complicate design and manufacture of the hinge assembly in that a change in damping characteristics requires a change of the internal components of the pneumatic or hydraulic damper, such as the piston and/or spring, which can increase cost and time required for damper design and manufacturing changes.

Hinges for lids for top-loading appliances such as washing machines and dryers preferably include or are often operatively connected to a counterbalance assembly that provides a desired counterbalance effect such that the lid/door requires no more than a select amount of force to open, stays open without external support when fully opened, self-closes by gravity without harsh slamming against the appliance body when the lid/door is moved to a select partially closed position, and remains closed during normal operating conditions of the appliance. The counterbalance assembly must fit in a limited area and be designed to operate even after prolonged and repeated exposure to water, soap, bleach, heat, etc.

A need has been identified for a new and improved appliance lid/door hinge counterbalance assembly that meets the above-noted design requirements while providing structural and functional advantages over known designs.

SUMMARY OF THE DISCLOSURE

In accordance with one aspect the present disclosure, an appliance lid hinge assembly includes a channel or channel housing including first and second spaced-apart side walls and a transverse face wall. The channel housing preferably includes: (i) a cavity located between the first and second side walls; and, (ii) a slot comprising first and second slot portions respectively located in said first and second side walls. The housing is pivotally connected to a cam via a rivet or other pivot fastener at a pivot point. The housing pivots relative to the cam about the pivot point between a lid closed position and a lid opened position.

In accordance with another aspect of the disclosure, the hinge assembly further includes a biasing spring assembly or slide body that acts between the housing and the cam in order to control the movement of housing relative to the cam about the pivot point. The spring assembly or slide body includes a spring rod that includes a roller at its inner end. The roller is engaged with and rides on a lobed edge of the cam. The slide body includes a spring such as a helical coil spring, and the spring rod extends coaxially through the spring. An outer end of the spring rod, opposite the roller, is slidably connected to the housing, and the spring is captured on the spring rod. The roller is connected to a yoke portion of the spring rod by a rivet, pin, or other roller fastener having opposite ends that are captured in linear (or non-linear) slots formed in the channel housing side walls. Sliding engagement of the opposite ends of the roller fastener in the slots serves to stabilize and control movement of the roller in the channel housing and limits the maximum inward and outward sliding movement of the roller. Alternatively, the spring assembly can include a torsion spring, and no slots formed in the channel housing side walls.

A hinge assembly in accordance with another aspect of the disclosure has a damper assembly including a damper operatively installed in the channel housing in order to provide a damper lid hinge. The damper has a body and a rod that extends and retracts relative to the body. The roller is connected to a first end of a damper and an opposite end of the damper is connected to the channel housing. The roller is connected to the damper housing and the damper rod is connected to the channel housing, but this arrangement can be reversed. The roller of the damper embodiment is slidably engaged with the slots that constrain its movement to a reciprocal linear path. The damper is preferably a fluid (liquid or gas) damper. The damper can further include an internal spring or internal fluid pressure that biases the rod toward its extended position. Otherwise, the spring lid hinge and the damper lid hinge operate in the same manner with respect to pivoting movement of the channel housing relative to the cam, the action of the roller on the lobe edge of the cam, and the movement of the roller in the channel housing as constrained by engagement of the roller pin in the slots.

In accordance with another aspect of the disclosure, the channel housing is mounted to an appliance lid via a lid pocket or receptacle and the cam is mounted to the appliance body via a mounting receptacle.

In accordance with another aspect of the disclosure, a snubber system can be connected to the channel housing in a location where a slide body is located between the snubber system and a first pivot point. The snubber system includes at least one or more snubbers and a piston wherein the snubber is biased to an extended position and selectively moveable to a retracted position against a damping resistance. The slide body contacts the snubber system during movement of the slide body away from the first pivot point when the channel housing moves from the first position to the second position and the slide body causes movement of the snubber from its extended position to its retracted position such that the snubber system damps movement of the slide body away from the first pivot point and damps movement of the channel housing toward its first position.

In accordance with another aspect of the disclosure, an appliance lid hinge assembly comprises a channel housing including first and second spaced-apart side walls and a transverse face wall. A cavity is located between the first and second side walls and adapted to be connected to the appliance lid. First and second slot portions are respectively located in the first and second side walls of the channel housing where the housing is pivotally connected to a cam via a rivet or other pivot fastener at a pivot point. A cam arm is adapted to be engaged with a mounting receptacle of an associated appliance body. A slide body is located adjacent the channel housing and is adapted for reciprocal sliding movement relative to the channel housing toward and away from the pivot point in response to pivoting movement of the channel housing relative to the cam arm between a first position and a second position. A biasing element is operably located between the slide body and the channel housing and resiliently biases the channel housing toward the first position.

A snubber assembly is connected to the channel housing in a location where the slide body is located between the snubber assembly and the pivot point. The snubber assembly comprises at least one snubber which is biased to an extended position and is selectively moveable to a retracted position against a damping resistance. The slide body contacts the snubber during movement of the slide body when the channel housing moves from the first position to the second position, and the slide body causes movement of the snubber from its extended position to its retracted position such that the snubber dampens movement of the slide body away from the pivot point and damps movement of the channel housing toward its first position.

Other aspects of the disclosure will become apparent upon a reading and understanding of the following detailed description.

DETAILED DESCRIPTION OF THE DISCLOSURE

Figure 1:
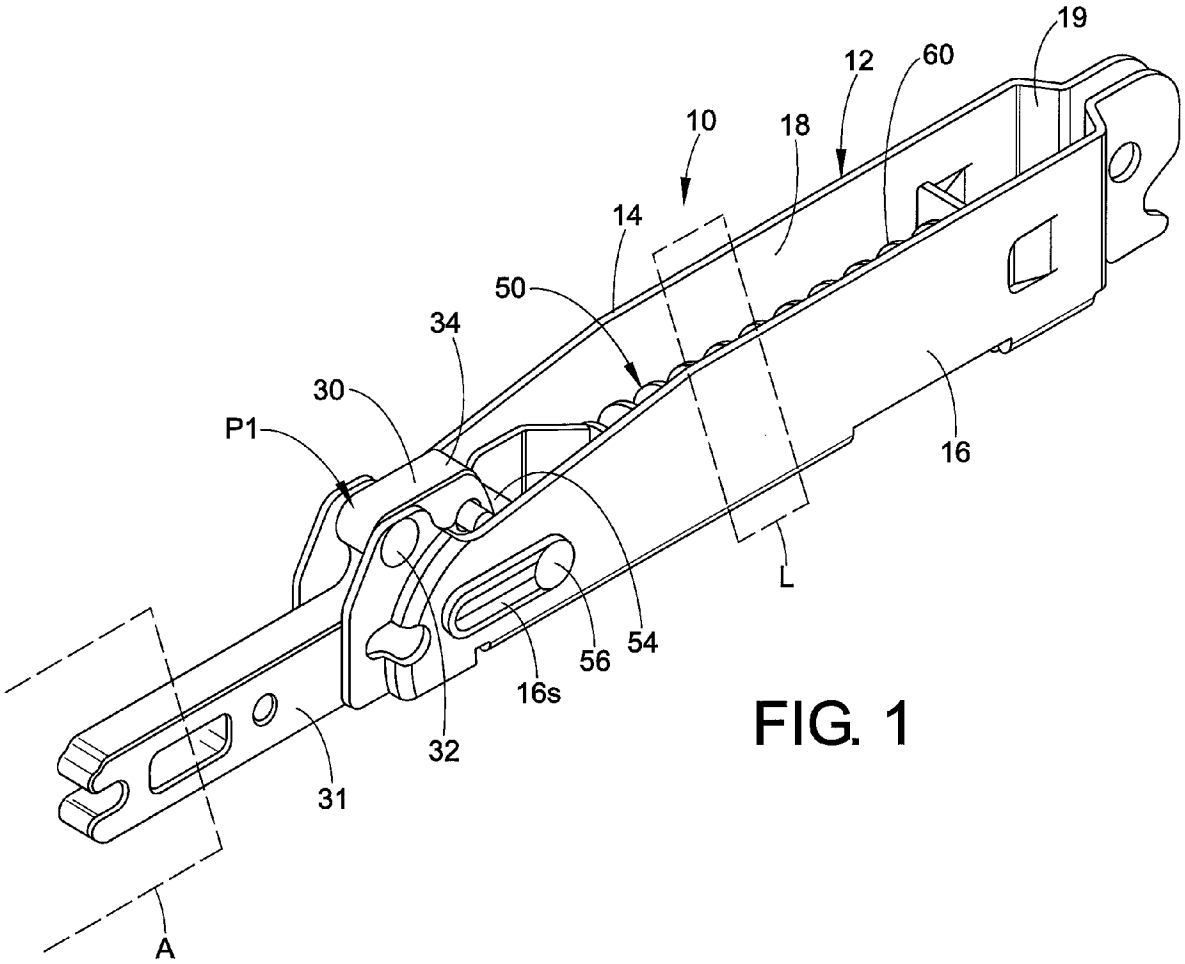
FIG. 1 is an isometric view of an appliance lid hinge assembly in accordance with one aspect of the disclosure with the appliance lid hinge assembly shown in a first operative position corresponding to a lid/door of the appliance being closed.

The appliance lid hinge assembly is particularly adapted for operative connection to an associated hinge arm that pivotally secures an appliance lid/door to an appliance body. For example, the appliance lid hinge assembly is adapted for operative connection to a hinge arm used for pivotally securing a lid/door of a top-loading washing machine or dryer to the body of the washing machine or dryer appliance.

Referring now to FIGS. 1-3 and 7, a spring lid hinge assembly 10 in accordance with one aspect of the disclosure is shown. The assembly 10 has a channel housing 12 which includes first and second longitudinally extending, parallel and spaced-apart walls 14, 16. The housing 12 defined from a one-piece metal stamping or a multi-piece assembly of metal or other components or other like structure. The housing side walls 14, 16 typically lie in respective vertical planes when the assembly 10 is operatively connected to a washer or other top-loading appliance. A cavity 18 is defined between the housing side walls 14, 16 and is closed at one end by a transverse face wall 19.

Figure 2:
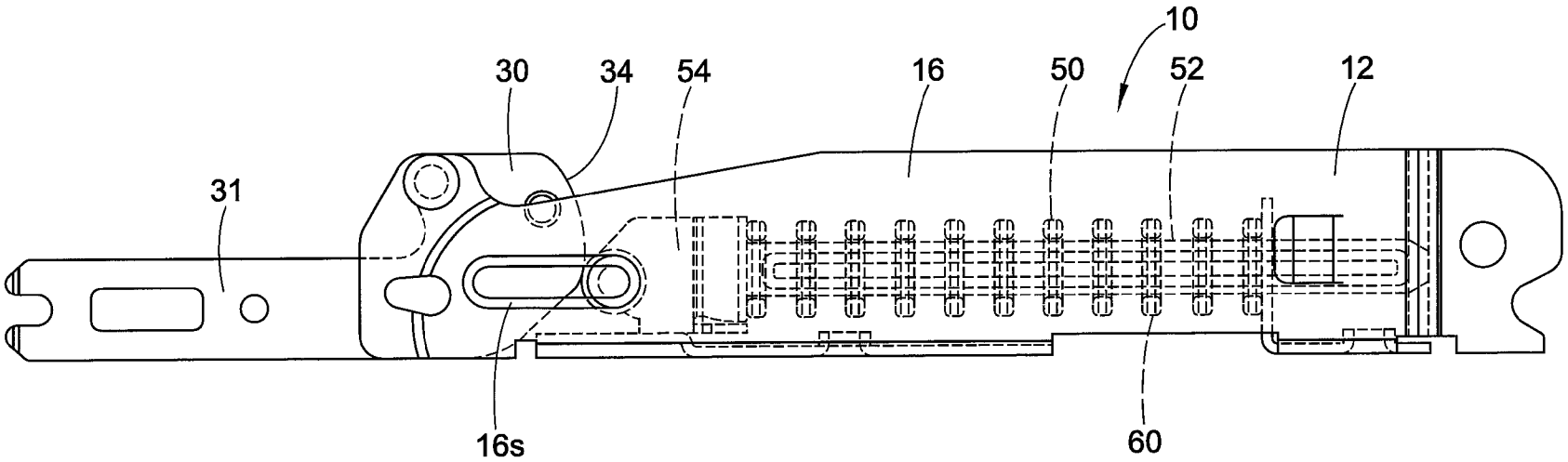
FIG. 2 is a side elevational view of the appliance lid hinge assembly of FIG. 1 in a closed position.
Figure 3:
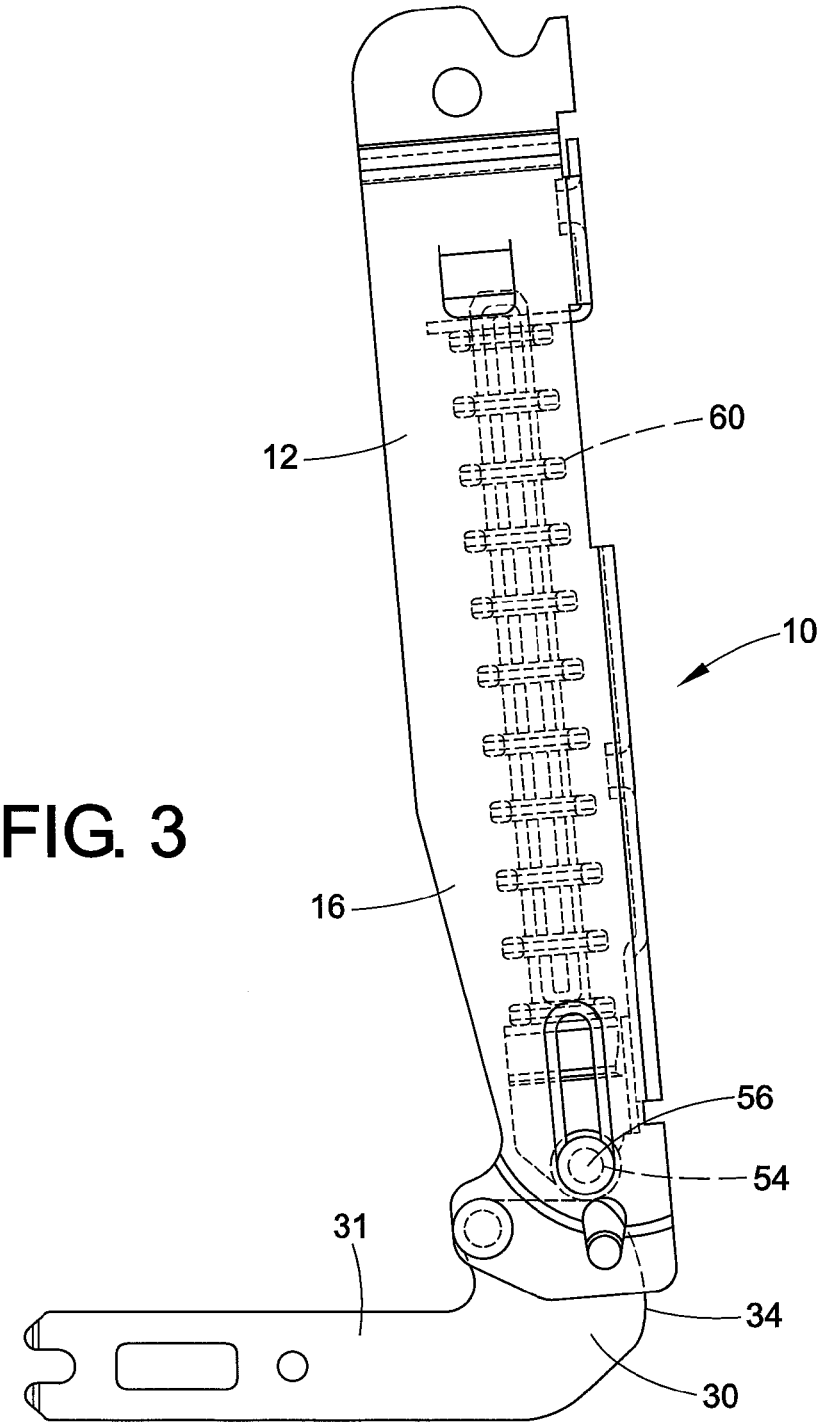
FIG. 3 is a side elevational view of the appliance lid hinge assembly of FIG. 1 shown in a second operative position corresponding to the lid/door of the appliance being opened.
Figure 4:
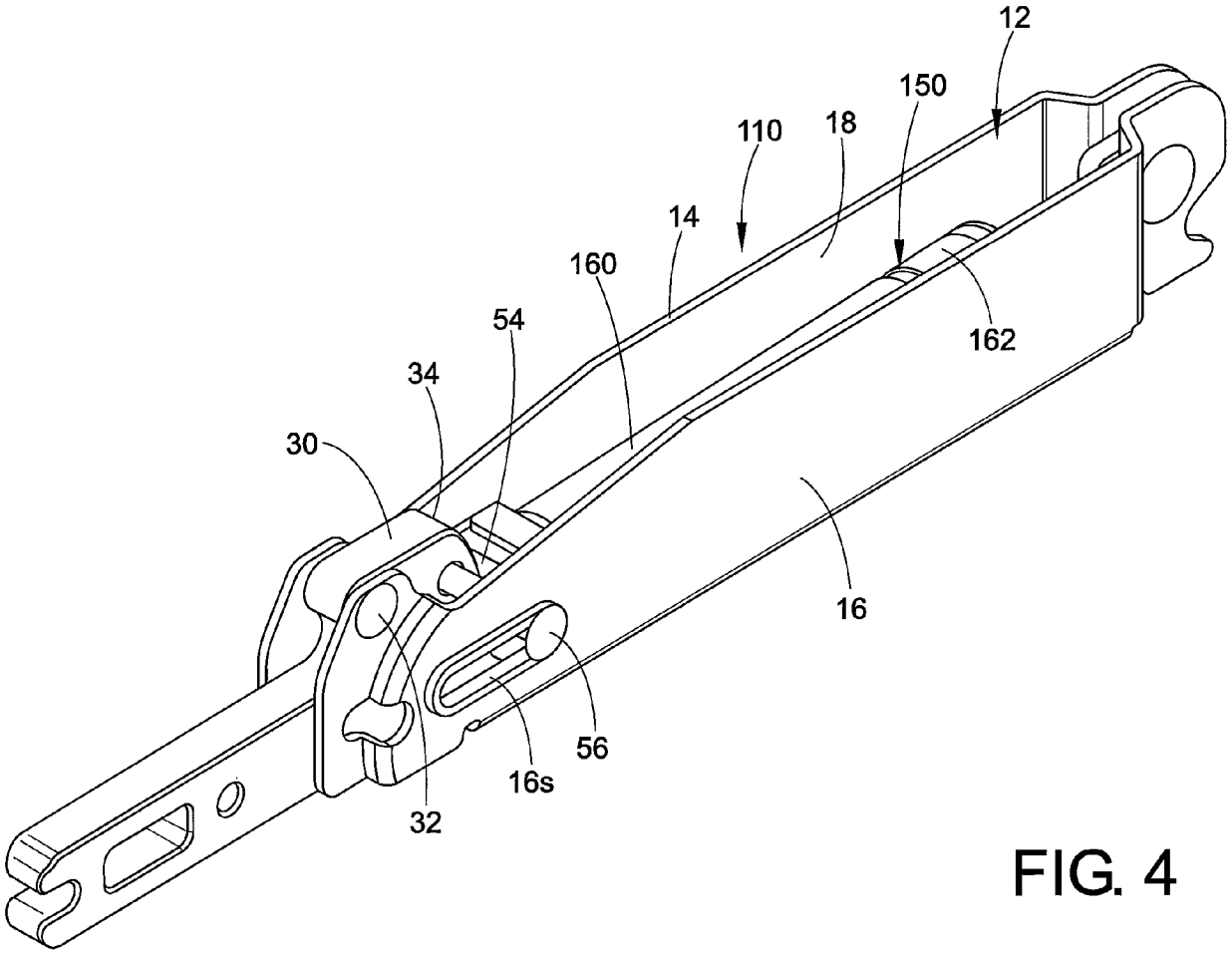
FIG. 4 is an isometric view of an appliance lid hinge assembly in accordance with another aspect of the disclosure with the appliance lid hinge assembly shown in a first operative position corresponding to a lid/door of the appliance being closed.
Figure 5:
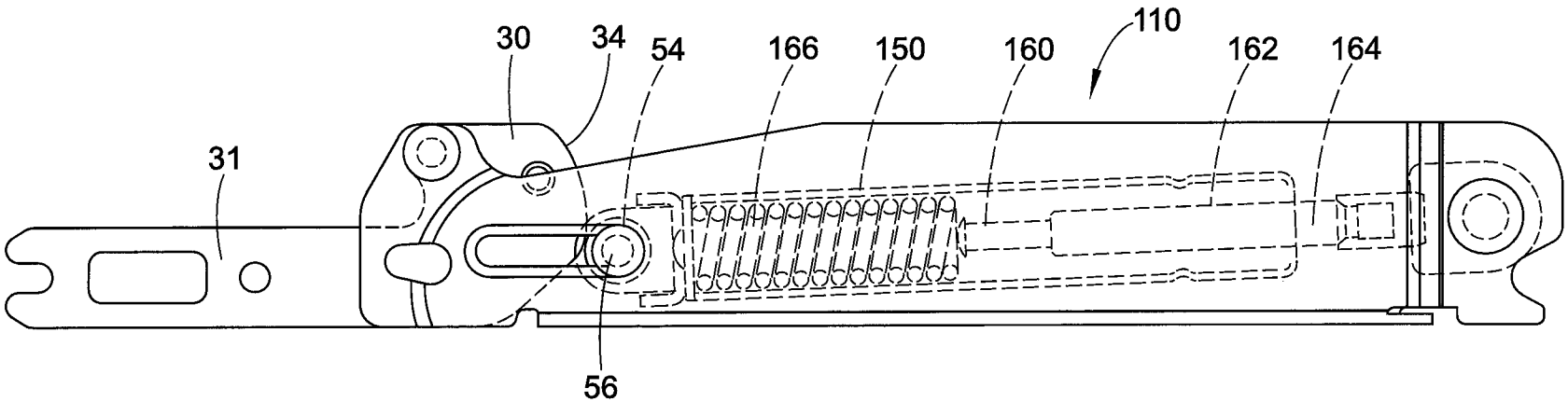
FIG. 5 is a side elevational view of the appliance lid hinge assembly of FIG. 4 in a closed position.
Figure 6:
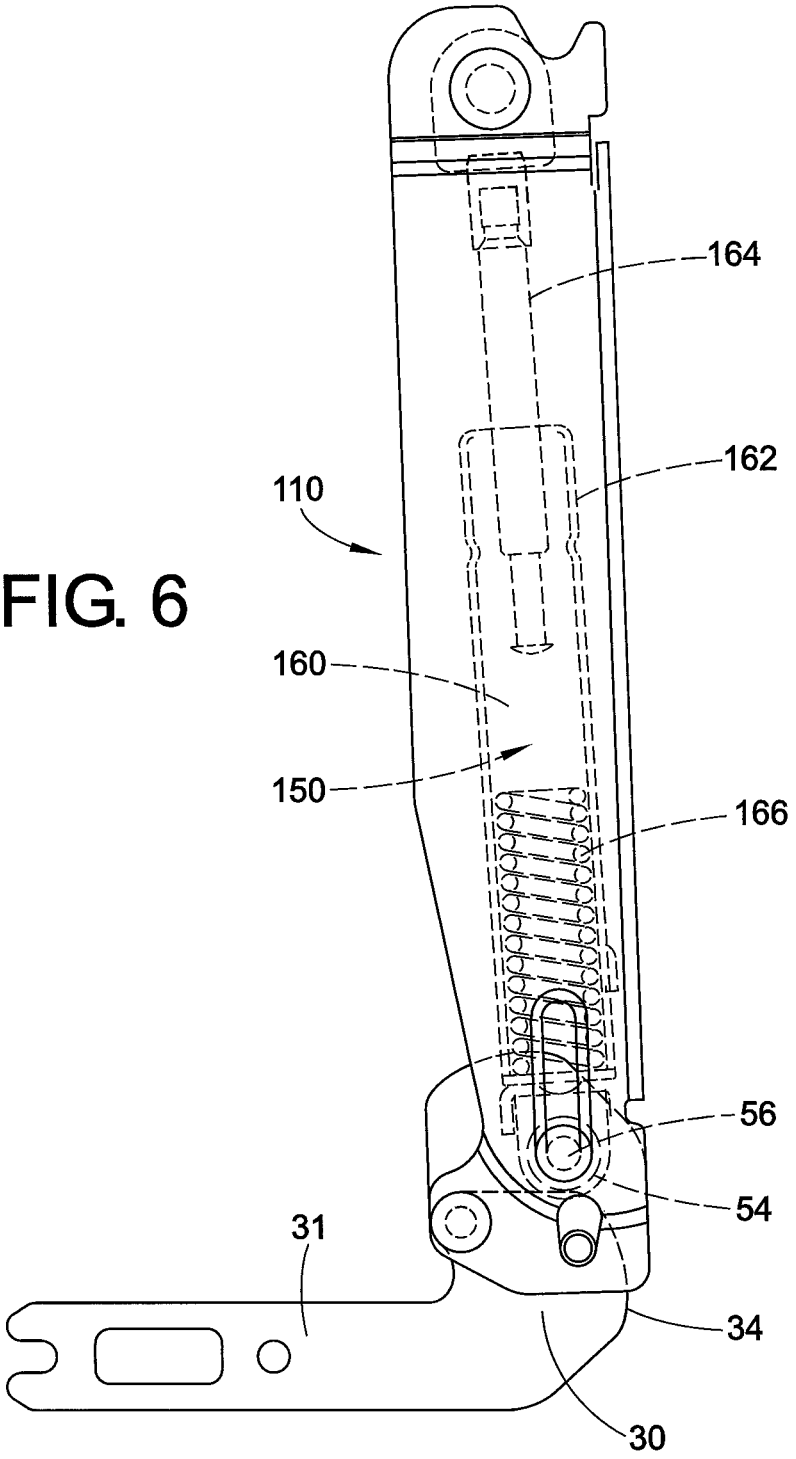
FIG. 6 is a side elevational view of the appliance lid hinge assembly of FIG. 4 shown in a second operative position corresponding to the lid/door of the appliance being opened.

The channel housing 12 is pivotally connected to a cam 30 extending from cam arm 31 via a rivet 32 or other pivot fastener at pivot point P1. The channel housing 12 pivots relative to the cam 30 about the pivot point P1 between a (lid) closed position as shown in FIG. 2 and a (lid) opened position as shown in FIG. 3. Cam arm 31 is attached to the appliance body A and the channel is attached to the lid L.

Referring to FIGS. 2 and 3, the spring hinge assembly 10 further includes a biasing slide body or spring assembly 50 that acts between the channel housing 12 and the cam 30 in order to control the movement of channel housing 12 relative to the cam 30 about pivot point P1. The slide body 50 includes a spring rod 52 that includes a roller 54 at its inner end. The roller 54 is engaged with and rides on a lobed edge 34 of the cam 30. The slide body 50 includes a spring 60 such as a helical coil spring, and the spring rod 52 extends coaxially through the spring 60. An outer end of the spring rod 52, opposite the roller 54, is slidably connected to the channel housing 12, and the spring 60 is captured on the spring rod 52. The roller 54 is connected to a yoke portion of the spring rod 52 by a rivet, pin, or other roller fastener 56 having opposite ends that are captured in linear slots 14*s*, 16*s* formed respectively in the channel housing side walls 14, 16 (only slot 16*s* is visible in the drawings, but slot 14*s* is identical to slot 16*s* but formed in side wall 14). Slots 14*s*, 16*s* are parallel and spaced-apart relative to each other. Sliding engagement of the opposite ends of the roller fastener 56 in the slots 14*s*, 16*s* serves to stabilize and control movement of the roller 54 in the channel 18 and limits the maximum inward and outward sliding movement of the roller 54.

Pivoting or rotational movement of the channel housing 12 in a first (lid-closing) direction (FIG. 2) about pivot point P1 in response to closing movement of the appliance lid to which the channel housing 12 is connected will result in the lobed cam profile or edge 34 inducing inward sliding translation of the roller 54 and spring rod 52 in a direction into the cavity 18 away from the cam 30 against the biasing force of the spring 60 so that the roller 54 is moved away from the cam 30 and the spring 60 is compressed. As such, the spring 60 counteracts the closing force of the appliance lid. Rotational movement of the channel housing 12 about pivot point P1 in an opposite second (lid-opening) direction (FIG. 3) during opening of the appliance lid will cause the roller 54 to move along the cam edge 34 in a manner that allows the spring 60 to resiliently lengthen and urge the roller 54 outward in a direction out of the housing 12, and the shape of the cam edge 34 is such that the spring 60 urges the channel housing 12 toward the lid-opened position which assists opening movement of the appliance lid. The slots 14*s*, 16*s* ensure that the roller 54 is constrained in the housing and can move only linearly in a reciprocal fashion along an axis that is parallel with the spring rod 52 at all times.

Referring now to FIGS. 4-6 and 8, a hinge assembly in accordance with another aspect of the disclosure is shown. In this embodiment, the slide body 50 is replaced with a damper assembly 150 including a damper 160 operatively installed in the channel 18 in order to provide a damper lid hinge 110. The damper 160 comprises a body 162 and a rod 164 that extends and retracts relative to the body 162. The roller 54 is connected to a first end of a damper 160 and an opposite end of the damper 160 is connected to the channel housing 12. In the illustrated embodiment, the roller 54 is connected to the damper housing 162 and the damper rod 164 is connected to the channel housing 12, but this arrangement can be reversed. As with the spring embodiment of FIGS. 1-3, the roller 54 of the damper embodiment is slidably engaged with the slots 14*s*, 16*s* that constrain its movement to a reciprocal linear path (only slot 16*s* is visible). The damper 160 is preferably a fluid (liquid or gas) damper. The damper 160 can include an internal spring 166 or internal fluid pressure that biases the rod 164 toward its extended position. Otherwise, the spring lid hinge 10 and the damper lid hinge 110 operate in the same manner with respect to pivoting movement of the channel housing 12 relative to the cam, the action of the roller 54 on the lobe edge 34 of the cam 30, and the movement of the roller 54 in the channel as constrained by engagement of the roller pin 56 in the slots 14*s*, 16*s*.

Figure 7:
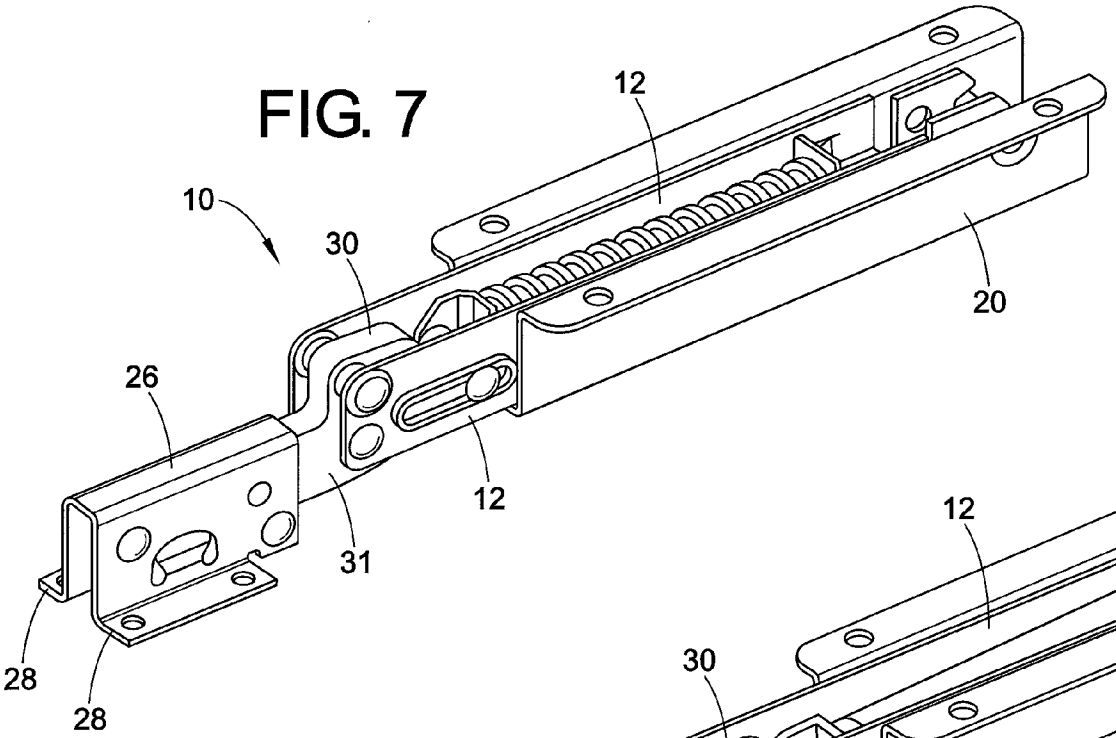
FIG. 7 is an isometric view of the appliance lid hinge assembly of FIG. 1 mounted to a lid pocket for securing the hinge assembly to an appliance lid and a receptacle for mounting the assembly to an appliance.
Figure 8:
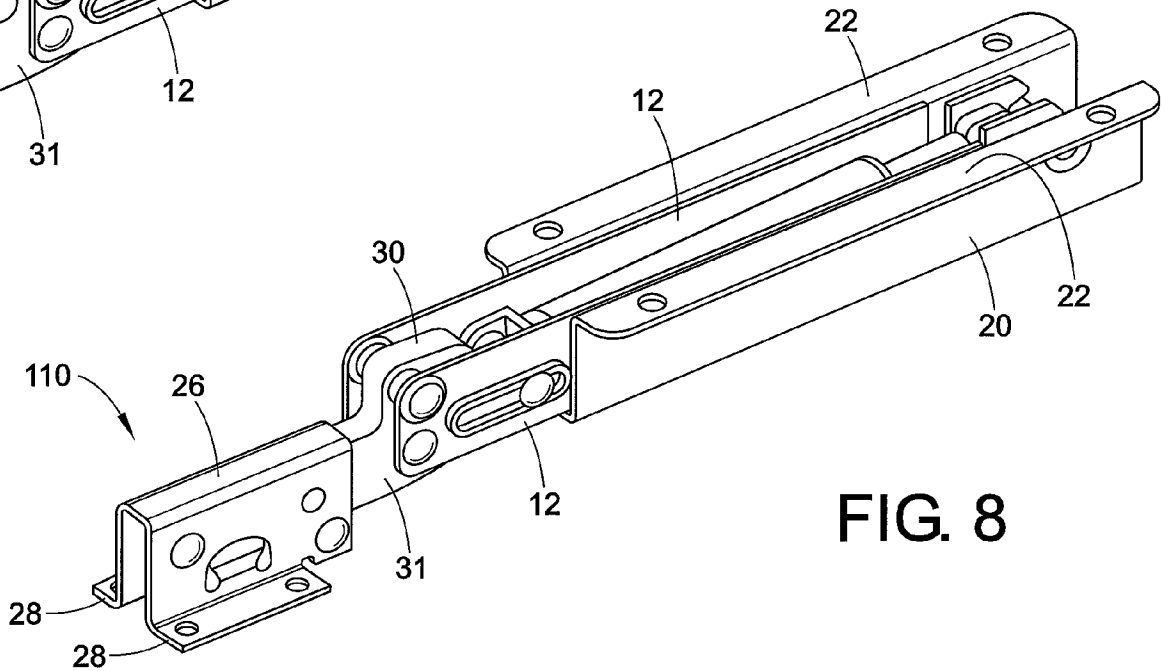
FIG. 8 is an isometric view of the appliance lid hinge assembly of FIG. 4 mounted to a lid pocket for securing the appliance lid hinge assembly to an appliance lid and a receptacle for mounting the assembly to an appliance.
Figure 9:
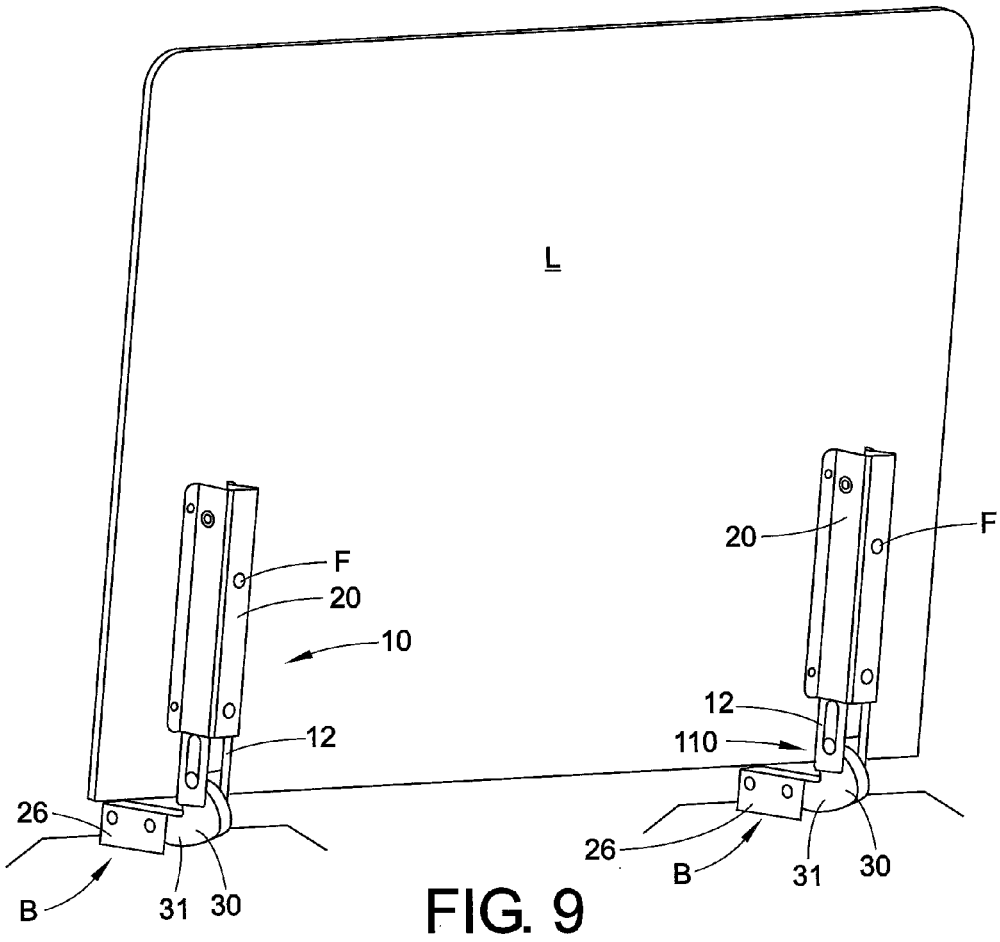
FIG. 9 is an isometric view of the hinge assemblies and lid pockets mounted to an appliance lid in an opened position and mounting receptacles mounted to an appliance.
Figure 11:
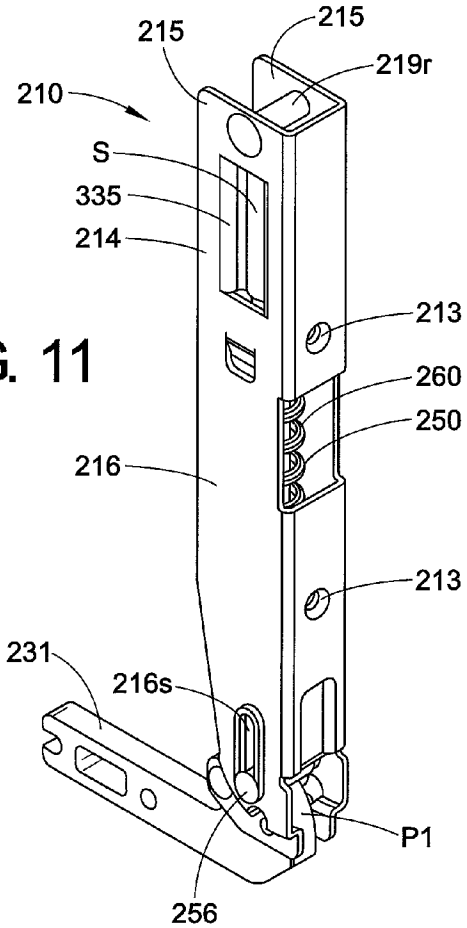
FIG. 11 is a perspective view of the hinge assembly of FIG. 10.
Figure 10:
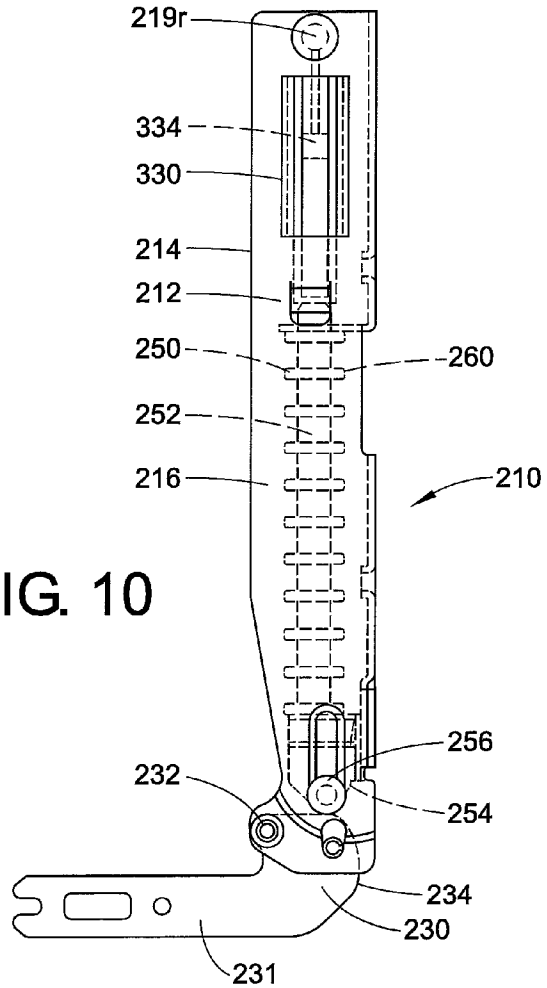
FIG. 10 is a side elevational view of a hinge assembly in a second, opened position with a snubber in accordance with another aspect of the disclosure.

Referring to FIGS. 7 and 8, for either the spring lid hinge 10 or the damper lid hinge 110, the channel housing 12 is mounted to the appliance lid L using a lid pocket 20. Each lid pocket 20 is secured to the appliance lid L of appliance A as shown in FIG. 9. The lid pockets are bonded or otherwise fastened to the glass or surface of the lid. The lid L and the pockets 20 are then slid onto the hinge assembly and retained to channel housing 12,212 via fasteners F (FIG. 9) which extend through openings 213 (FIG. 11). Typically, the appliance lid L includes first and second laterally spaced-apart lid pockets 20, one of which is used to mount a spring lid hinge 10 and the other of which is used to mount a damper lid hinge 110. Alternatively, two spring lid hinges 10 or two damper hinges 110 can be used. Each lid pocket 20 includes mounting tabs or flanges 22 for attaching the pocket to the appliance lid L. The channel housing 12 of the lid hinge 10 or 110 is secured in the lid pocket 20 using one or more pins, screws, or other fasteners. Alternately, the channel housing 12 can be mounted directly to the appliance lid.

Similarly, the cam 30 of either the spring lid hinge 10 or the damper lid hinge 110 is secured to an appliance body B using a mounting receptacle 26 also shown in FIGS. 7 and 8. Each receptacle 26 is secured to the appliance body B as shown in FIG. 9. Alternately, the cam 30 and the receptacle 26 can be combined as one integral part. Typically, the appliance body B includes first and second laterally spaced-apart receptacles 26, one of which is used to mount a spring lid hinge 10 and the other of which is used to mount a damper lid hinge 110. Each receptacle 26 includes mounting tabs or flanges 28 for attaching the pocket to the appliance lid L. The cam 30 of the lid hinge 10/110 includes arm or shank or other projecting portion 31 that is inserted into the receptacle 26 and secured therein using one or more pins, screws, or other fasteners. All parts of the cam 30 lie in a single plane that is also aligned with the cavity 18 of the channel housing 12. In use, the channel housing 12 and the lid pocket 20 in which the channel housing 12 is secured rotate in the same plane as the cam 30.

In accordance with another aspect of the disclosure, another embodiment of the lid hinge is an alternative to the integrated damper hinge. To obtain a damper hinge, the spring hinge has a damper and the end of the channel housing that is engaged when the spring rod contacts the damper. As the lid closes, the spring rod extends back toward the end of the channel housing (away from the hinge cam) and is used to compress a small plunger style damper, i.e., a snubber. When the hinge is opened, a small internal spring with the snubber resets the snubber so that it can then dampen when closed. The spring rod would not necessarily need to contact the damper throughout the complete travel from open to closed lid position. The spring rod could contact the damper only in the region of the lid closing where the lid is required to have its closing motion controlled. For example, if a customer only wanted the lid to close softly from 30 degrees to closed position, the spring rod could just start the engagement at 30 degrees.

According to another aspect of the disclosure, a single snubber is captured by the sides of the channel housing. A rod on the snubber contacts the rivet and the body of the snubber contacts the spring rod. As the lid closes, the snubber is compressed and dampens the lid motion. A housing is used to contain the damper and single snubber.

Referring now specifically to FIGS. 10-16, hinge assembly 210 (parts are similar to hinge 10) further comprises a snubber system or snubber subassembly 330 connected to a cavity 214 formed by channel housing 212 and located in space S adjacent second or outer end 215 of the cavity 214 such that the slide body 218 is located between the snubber subassembly 330 and the pivot point P1 adjacent cam portion 230 of cam arm 231. Slide body 218 has a spring assembly 250 including spring rod 252 and a spring such as a helical coil spring 260 which is retained by wall 221 formed by housing 212. Channel housing 212 is pivotably connected to cam 231 via rivet 232. Roller 254 is connected to the spring rod 252 by fastener 256, which is captured in linear slots 216*s* and is engaged with and rides on lobed edge 234 of cam 230. The snubber subassembly 330 has a metal or polymeric snubber 334 located and anchored in the channel space S which is formed by inwardly bent walls 335 of channel housing 212 which form a pocket or opening which aligns and centers the snubber within the cavity 214 while also permitting the snubber to move or translate along the longitudinal axis of the channel housing. The snubber 334 can also otherwise be secured in the channel space S by other means.

Figure 12:
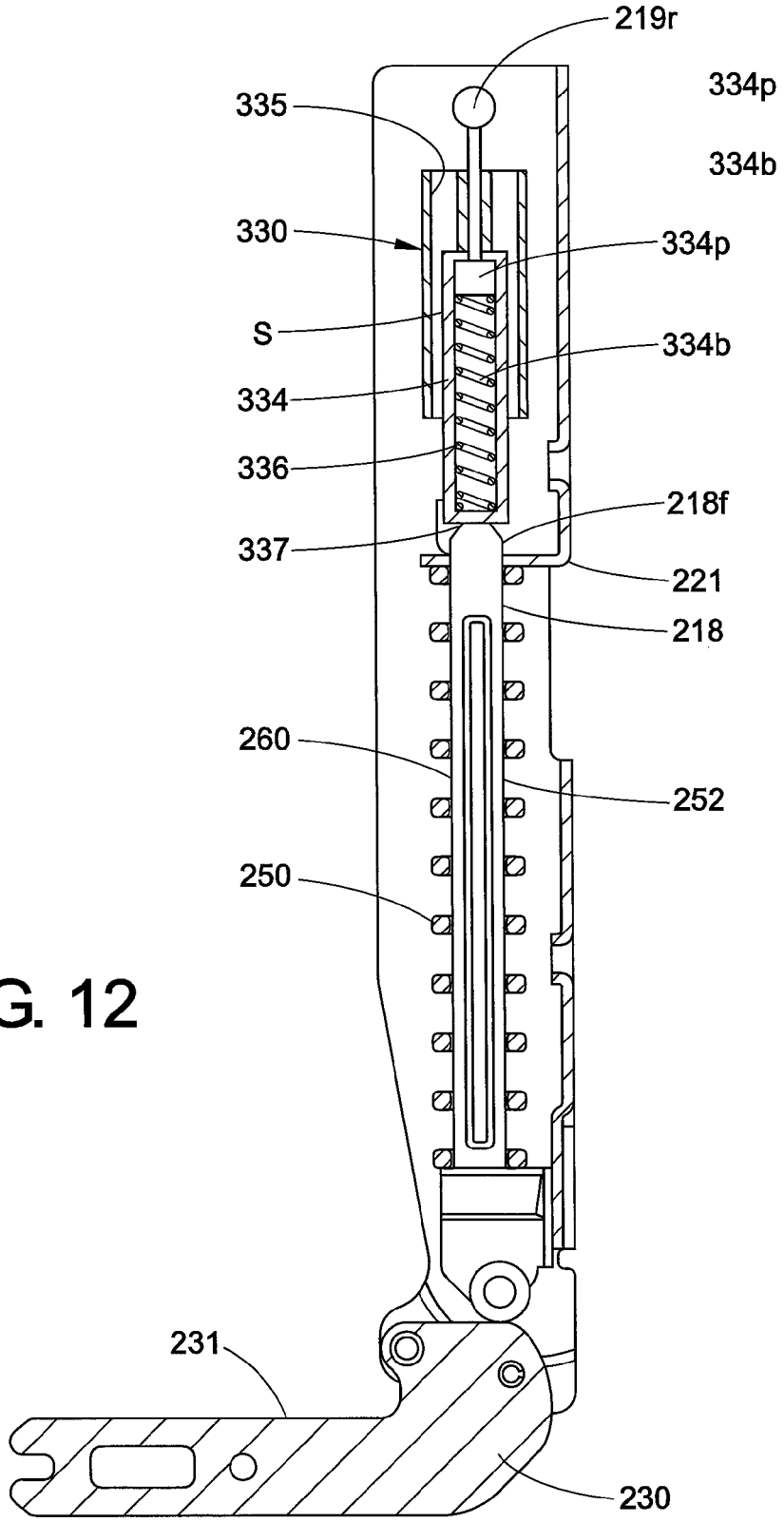
FIG. 12 is a side elevational view in cross section of the hinge assembly of FIG. 10.

In the illustrated embodiment, the snubber subassembly 330 includes one snubber 334. With particular reference to FIG. 12 and the section view of the snubber shown in FIG. 13, each snubber 334 has a tubular or cylindrical body 329 including a cylindrical bore 334*b* in which a piston 334*p* is disposed. The piston 334*p* comprises a rod 334*r* connected thereto and that projects out of the bore 334*b* away from an inner closed end 339 of the bore 334*b*, and each piston rod 334*r* projects outwardly from the snubber 334 toward the rivet 219*r*. Each snubber 334 is adapted to reciprocate the piston in its bore 334*b* between an extended position of the snubber as shown in FIG. 12 where the rod 334*r* projects a maximum distance out of the bore 334*b* and a retracted position of the snubber (see e.g., FIGS. 14 and 16) in which the piston 334*p* and piston rod 332*r* extend deeper into the bore 334*b* as the snubber 334 is moved by the slide body against a damping resistance so that the rod 334*r* projects outward from the bore 334*b* a lesser distance as compared to the extended position. The snubber itself moves relative to the piston and rod which remain fixed relative to rivet 219*r*. The orientation of the snubber can also be reversed wherein the rod 334*r* is in contact with the slide body and the piston moves relative to the slide body.

Each snubber 334 is biased to its extended position by a spring, a fluid, an elastomeric body, and/or another biasing element or biasing means 336 within bore 334*b*. In the illustrated embodiment, the biasing element 336 comprises a helical coil spring, but the present development is not limited to use of a helical spring. Each snubber 334 is movable from its extended position toward its retracted position by external force exerted on the snubber body by transverse face 218*f* of slide body 218 against the biasing force of the spring or other biasing element 336 and against the damping resistance of a fluid contained in the bore 334*b*.

In use of the hinge assembly 210, the slide body 218 has a transverse face 218*f* that engages outer wall 337 of the snubber subassembly 330 when the channel housing 212 is moved from its second (lid-opened) position (FIG. 10) toward its first (lid-closed) position (FIG. 14), before the channel housing 212 reaches its first (lid-closed) position such that the snubber subassembly 330 cushions or dampens movement of the slide body 218 and thus the channel housing as the channel housing approaches and moves to its first position in order to prevent a hard closing or "slamming" of the appliance lid. In the illustrated embodiment, the slide body 218 has a transverse face 218*f* or other structure that engages the snubber body 334 of the snubber subassembly 330 when the channel housing 212 is moved from its second (lid-opened) position toward its first (lid-closed) position. The transverse face 218*f* of the slide body 218 remains in continuous contact with the snubber body 334 between the lid opened and closed positions. Further movement of the channel housing 212 toward the first (lid-closed) position will cause the slide body 218 to move further away from the first pivot point P1 toward the snubber subassembly 330 so as to urge the snubber body 334 towards the piston 334*p* to a retracted position, thereby compressing oil or hydraulic liquid 334*l* within the snubber causing damping. The slide body 218 maintains continuous contact with the snubber 334 for all locations of the channel housing 212 between and including said first position.

In one embodiment, the snubber 334 includes a volume of oil 3341 filled in its bore 334*b* to provide the damping resistance. The piston 334*p* is sealingly engaged with the peripheral wall of the snubber to prevent the flow of oil between the peripheral wall of the snubber and the piston 334*p*. The piston 334*p* has at least one orifice 334*po* or other restricted flow path(s) that allow(s) hydraulic fluid such as oil to flow through or around the piston 334*p* from the inner side of the piston 334*p* (the side of the piston 334*p* oriented toward the biasing element 336) to the opposite outer side of the piston 334*p* (the side of the piston 334*p* oriented away from the biasing element 336). The orifice 334*po* is restricted sufficiently such that a large force is required to move the piston 334*p* inward toward the biasing element 336 as the oil flows through the orifice 334*po*. Preferably, the piston 334*p* is also configured so that the flow of fluid or oil is less restricted through the one or more orifices 334*po* (or a different set of one or more orifices such as the return orifice 334*t* incorporating a check valve) in the opposite direction, i.e., from the outer side of the piston 334*p* to the inner side of the piston 334*p* so that the biasing element 336 can return the snubber from its retracted position to its extended position with minimal force and in a short time as compared to the force required to move the snubber from its extended position to its retracted position as diagrammatically shown in FIG. 13.

Figure 14:
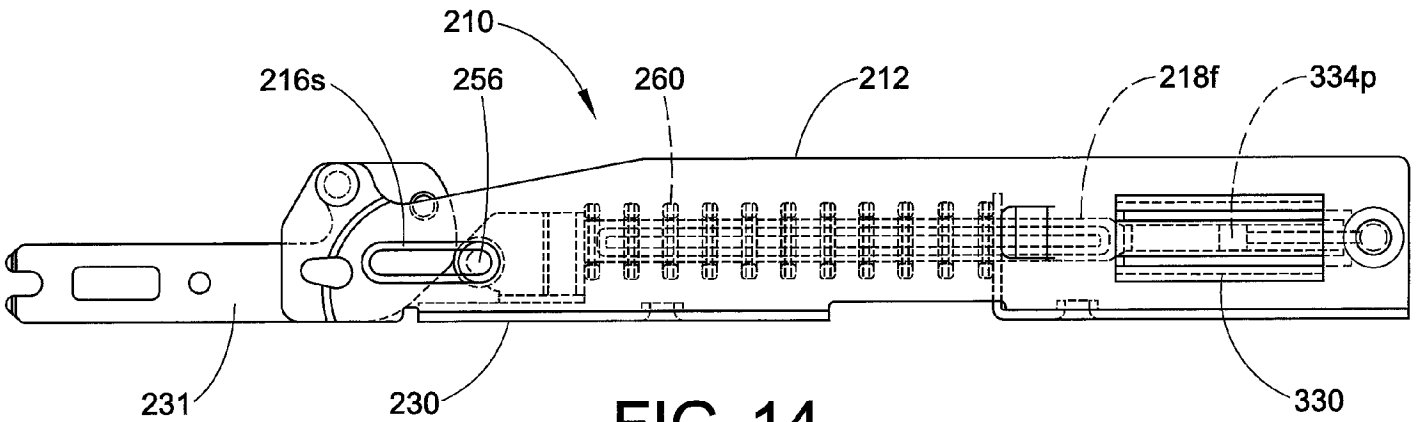
FIG. 14 is a side elevational view of a hinge assembly in a first closed position with a snubber in accordance with one aspect of the disclosure.
Figure 15:
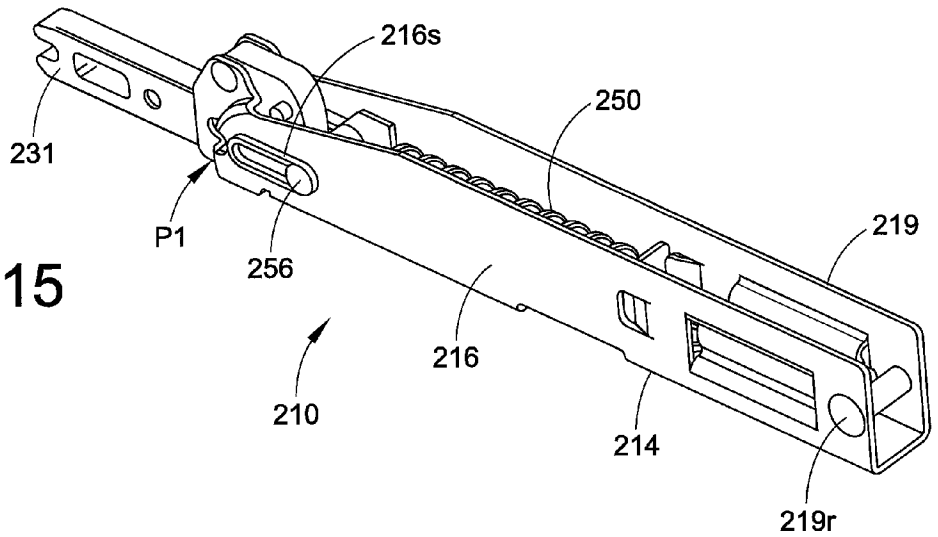
FIG. 15 is a perspective view of the hinge assembly of FIG. 14.
Figure 16:
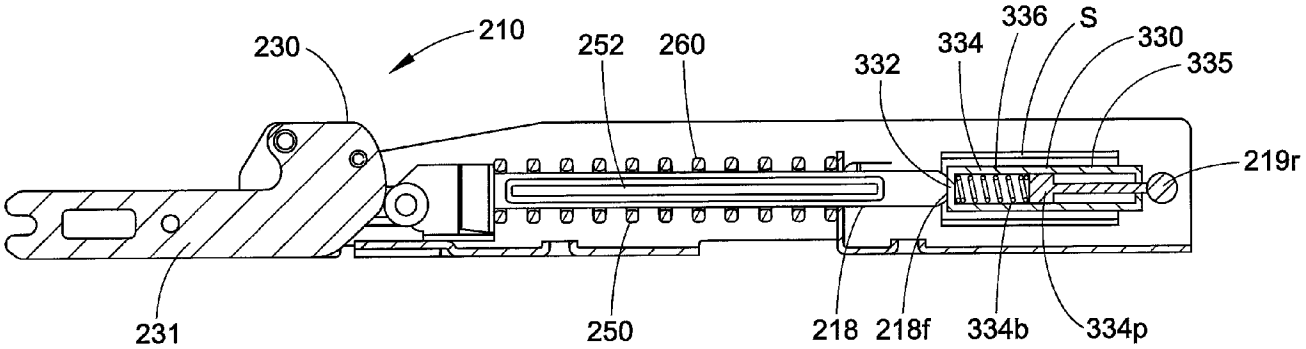
FIG. 16 is a cross-sectional view of the hinge assembly of FIG. 15.
Figure 18:
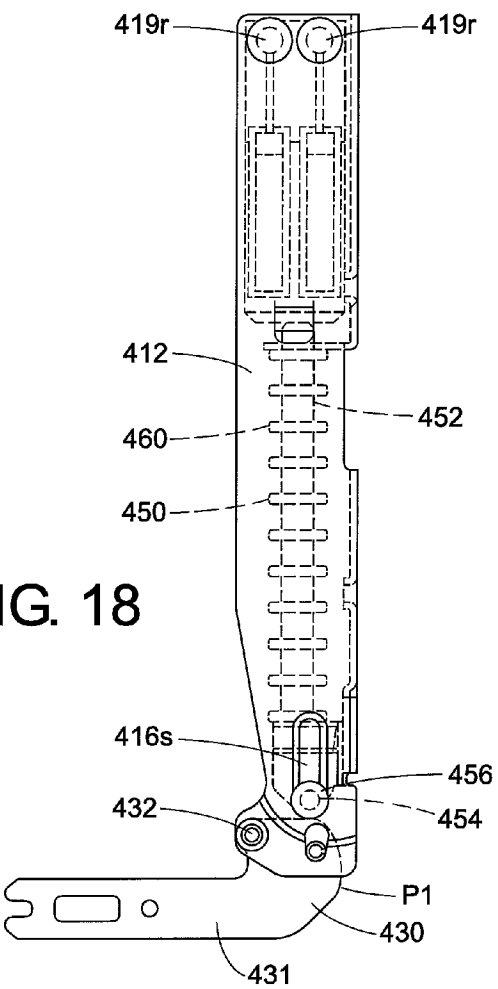
FIG. 18 is a side elevational view of the hinge assembly of FIG. 17.
Figure 17:
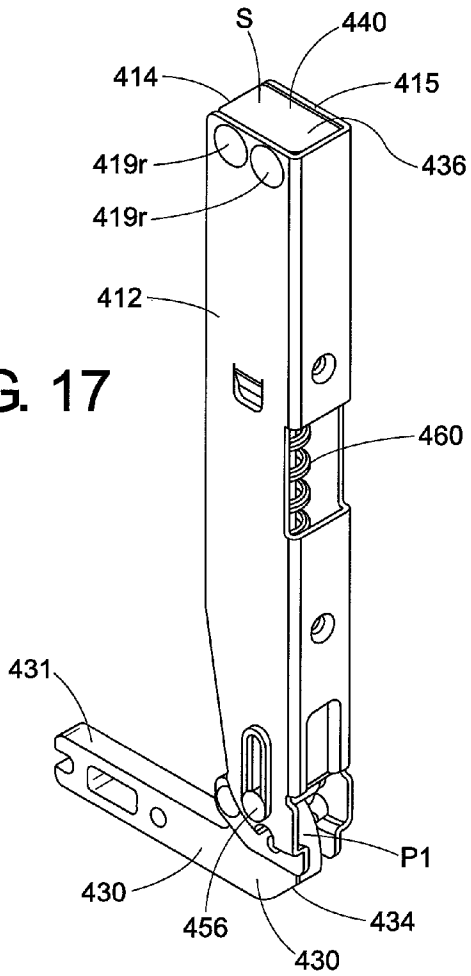
FIG. 17 is a perspective view of a hinge assembly in a second, opened position with a snubber assembly having two snubbers in accordance with another aspect of the disclosure.

The snubber subassembly 330 thus cushions or dampens movement of the slide body 218 away from the pivot point P1 from the first (lid-closed) position shown in FIGS. 14-16 and correspondingly cushions or dampens movement of the channel housing 212 as it moves toward its first position so that an appliance lid connected to the channel will exhibit a "soft-close" characteristic and will close with less force than if the snubber subassembly 330 was not present, in order to prevent the appliance lid from closing with excessive force, speed, or noise. The snubber subassembly 330 also improves the consistency of the speed or rate of closing of the lid connected to the channel housing 212.

In an alternative embodiment, the biasing element 336 is used not only to return the snubber and piston 334*p* from its retracted position to its extended position, but also to provide sufficient damping force or resistance that resists movement of the piston 334*p* into the snubber 334 from its extended position to its retracted position to cushion or damp movement of the slide body 218 away from the pivot point P1 and correspondingly cushion or damp movement of the channel 214 as it moves toward its first position so that an appliance lid connected to the channel will exhibit a "soft-close" characteristic and will close with less force than if the snubber subassembly 330 was not present, in order to prevent the appliance lid from closing with excessive force, speed, or noise.

According to another aspect of the disclosure, two snubbers are paired together in a single housing. Referring specifically to FIGS. 17-22, hinge assembly 410 (parts are similar to hinge assembly 10 of FIGS. 1-3) can have a snubber system or snubber subassembly 440 connected to or mounted within cavity 414 formed by channel housing 412 and located in the space S adjacent the second or outer end 415 of the channel housing 412 such that the slide body 418 is located between the snubber subassembly 440 and the pivot point P1 adjacent cam 430 of cam arm 431. Slide body 418 has a spring assembly 450 including a rod 452 and a spring such as a helical coil spring 460 which is retained by wall 421 formed by housing 412. Roller 454 is connected to spring rod 452 by fasteners 456, which are captured in linear slots 416*s* and is engaged with and rides on lobed edge 434 of cam 4301. Housing 412 is pivotably connected to cam 430 via rivet 432.

Figure 19:
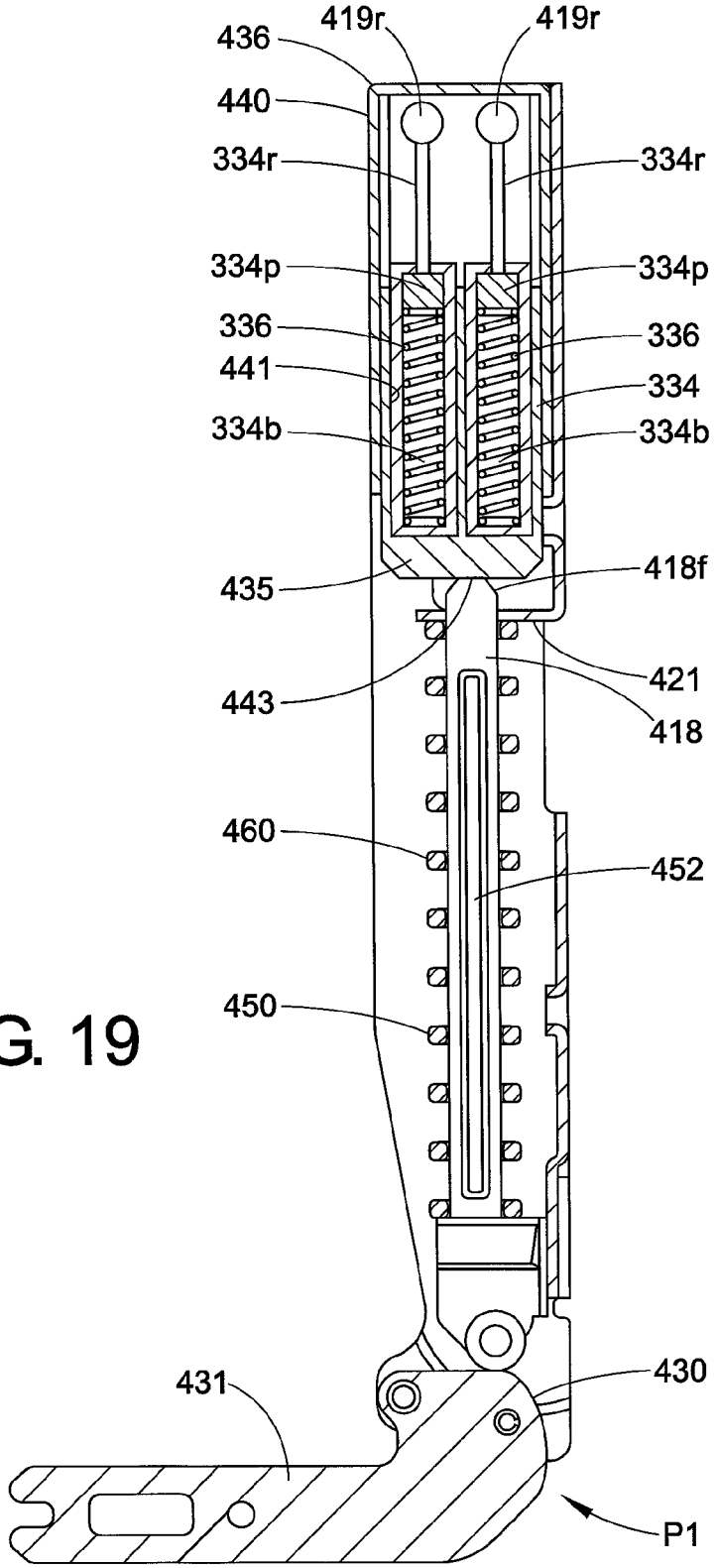
FIG. 19 is a cross-sectional view of the hinge assembly of FIG. 17.
Figure 20:
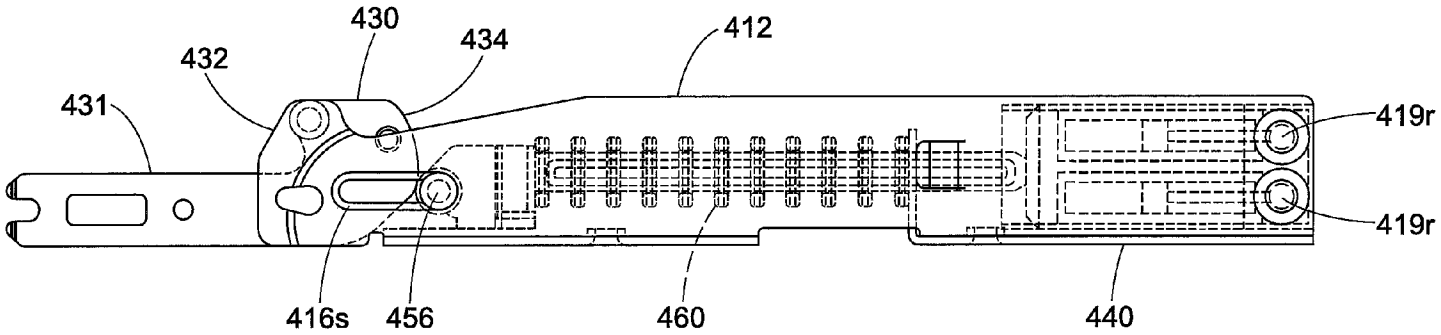
FIG. 20 is a side elevational view of a hinge assembly having a snubber subassembly having two snubbers in a first, closed position in accordance with one aspect of the disclosure.
Figure 21:
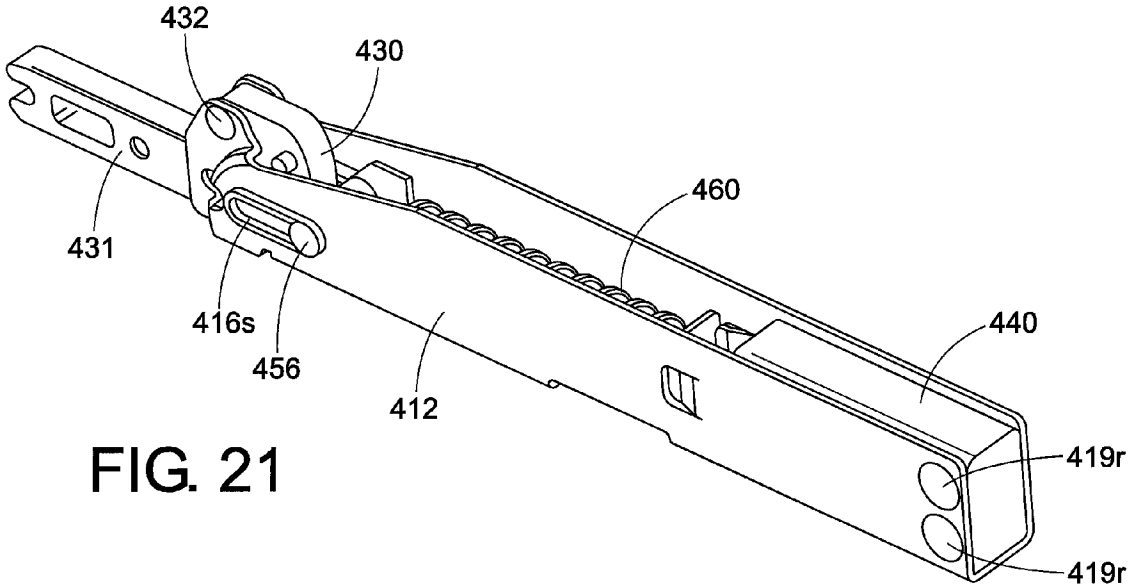
FIG. 21 is a perspective view of the hinge assembly of FIG. 20.
Figure 22:
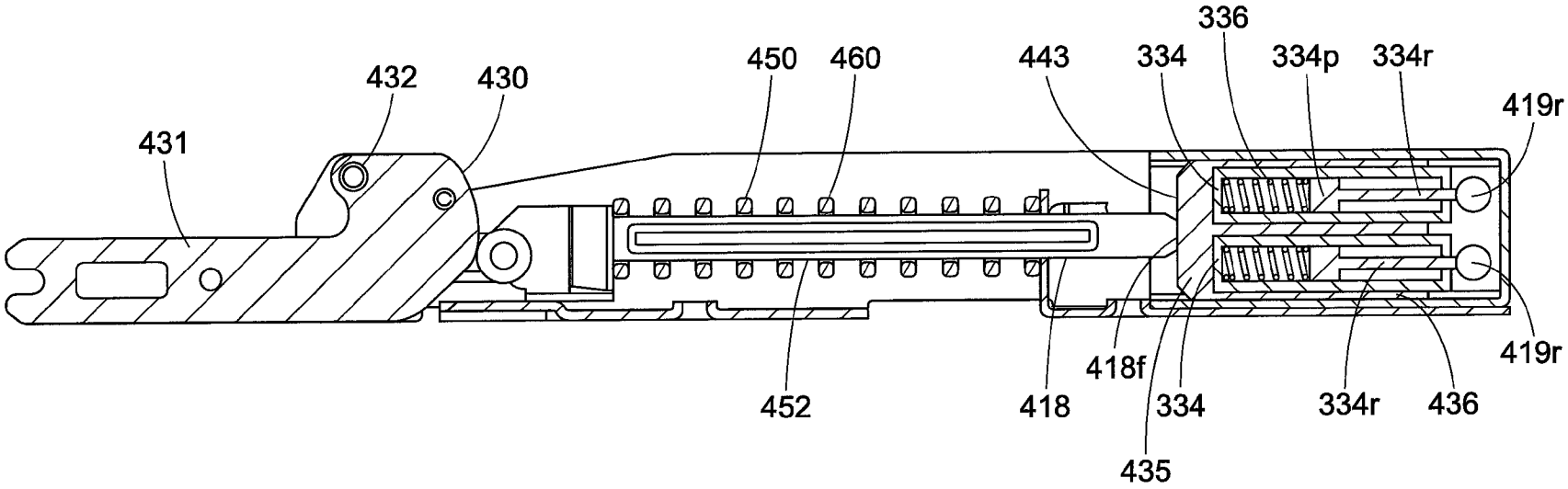
FIG. 22 is a side elevational view in cross section of the hinge assembly of FIG. 20.

Referring to FIG. 19, the snubber subassembly 440 comprises a metal or polymeric snubber base 435 located and positioned in the channel space S and abuts transverse face 418*f* of slide body 418. As shown, one or more rivets or other fasteners 419*r* are used to anchor the snubber upper cover 436 in the channel space S above the base. In the illustrated embodiment, the snubber subassembly 440 comprises at least one and, as shown, a first and an optional second snubber 334 mounted within passages or openings 441 formed in the base 435 by being inserted into the openings 441 of the base 435.

Figure 13:
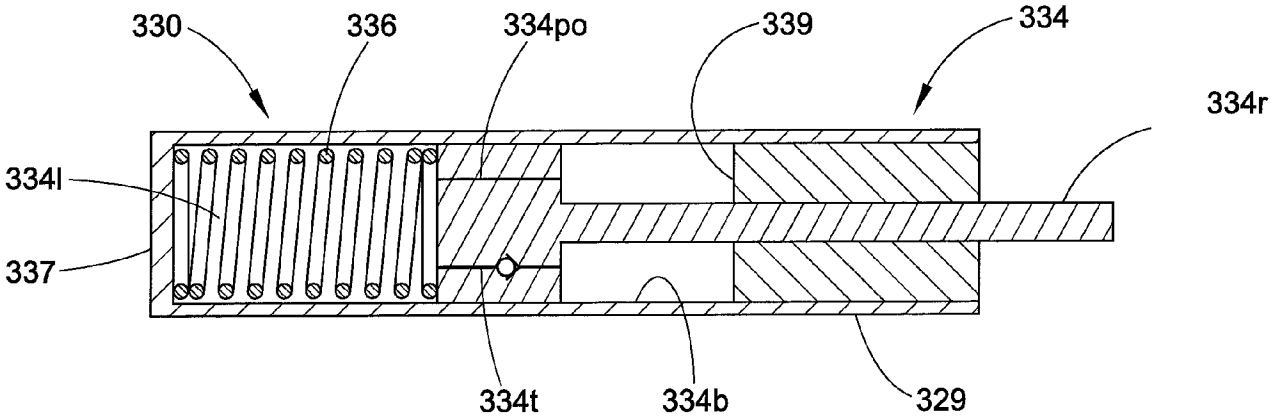
FIG. 13 is a cross sectional view of a snubber portion of a snubber assembly formed in accordance with one embodiment.

With particular reference to FIGS. 13, 14 and 19, each snubber 334 comprises a tubular body including a cylindrical bore 334*b* in which a piston 334*p* is slidably disposed. The piston 334*p* comprises a rod 334*r* connected thereto and that projects out of the orifice 334*b* away from an inner closed end 339 of the bore 334*b*, and each piston rod 334*r* projects outwardly from the snubber base 435 toward the rivets 419*r*. Each piston 334*p* extends into and out of bore 334*b* as the snubber 334 itself moves between an extended position as shown in FIG. 19 where the snubber projects a maximum distance out of the opening 441 and a retracted position (see e.g., FIG. 22) in which the piston 334*p* and piston rod 334*r* are urged deeper into the bore 334*b* of snubber 334 against a damping resistance so that the rod 334*r* projects outward from the bore 334*b* a lesser distance as compared to the extended position. Each snubber 334 is biased to its extended position by a spring, a fluid, an elastomeric body, and/or another biasing element or biasing means 336 within bore 334*b*. In the illustrated embodiment, the biasing element comprises a helical coil spring, but the present development is not limited to use of a helical spring. Each snubber 334 is movable from its extended position toward its retracted position by external force exerted on the snubber against the biasing force of the spring or other biasing element 336 and against the damping resistance of a fluid contained in the bore 334*b*.

In use of the hinge assembly 410, the slide body 418 engages outer wall 443 of the snubber subassembly base 435 when the channel housing 212 is moved from its second (lid-opened) position (FIG. 19) toward its first (lid-closed) position (FIG. 22), before the channel housing 212 reaches its first (door-closed) position such that the snubber subassembly 440 cushions or dampens movement of the slide body 418 and thus the channel housing 212 as the channel approaches and moves to its first position in order to prevent a hard closing or "slamming" of the appliance lid. In the illustrated embodiment, the slide body 418 comprises a transverse face 418*f* or other structure that engages the wall 443 of the snubber subassembly 440 when the channel housing 212 is moved from its second (lid-opened) position toward its first (lid-closed) position. The transverse face 418*f* contacts the wall 443 when the channel housing 212 is moving from its second (lid-opened) position toward its first (lid-closed) position. Further movement of the channel 414 toward the first (lid-closed) position will cause the slide body 418 to move further away from the first pivot point P1 toward the snubber subassembly 440 so as to urge the snubbers 334 toward their retracted positions. The slide body 418 maintains continuous contact with the snubbers 334 for all locations of the channel housing 212 between and including first and second positions.

In one embodiment, each snubber 334 includes a volume of oil or other liquid filled in its bore 334*b* to provide the damping resistance. The piston 334*p* is sealingly engaged with the peripheral wall of the bore 334*b* to prevent the flow of oil between the peripheral wall of the bore 334*b* and the piston 334*p*. The piston 334*p* comprises at least one orifice 334*po* or other restricted flow path(s) that allow(s) hydraulic fluid or oil to flow through or around the piston 334*p* from the inner side of the piston 334*p* (the side of the piston 334*p* oriented toward the biasing element 336) to the opposite outer side of the piston 334*p* (the side of the piston 334*p* oriented away from the biasing element 336). The orifice 334*p* is restricted sufficiently such that a large force is required to move the piston 334*po* inward toward the biasing element 336 as the oil/fluid flows through the orifice 334*po*. Preferably, the piston 334*p* is also configured so that the flow of oil is less restricted through the one or more orifices 334*po* (or a different set of one or more orifices such as the return orifice 334*t* incorporating a check valve) in the opposite direction, i.e., from the outer side of the piston 334*p* to the inner side of the piston 334*p* so that the biasing element 336 can return the piston from its retracted position to its extended position with minimal force and in a short time as compared to the force required to move the piston 334*p* from its extended position to its retracted position as diagrammatically shown in FIG. 13.

Thus, the snubber subassembly 440 cushions or dampens movement of the slide body 418 as the lid moves toward its first (lid-closed) position and correspondingly cushions or dampens movement of the channel housing 212 as it moves toward the lid closed position so that an appliance lid connected to the channel housing will exhibit a "soft-close" characteristic and will close with less force than if the snubber subassembly 440 was not present, in order to prevent the appliance door from closing with excessive force, speed, or noise. The snubber subassembly 440 also improves the consistency of the speed or rate of closing of the door/lid connected to the channel housing.

Modifications and alterations will occur to those of ordinary skill in the art to which the disclosure pertains upon reading and understanding this specification. It is intended that the claims be construed as broadly as possible while maintaining their validity to encompass all such modifications and alterations.

The invention claimed is:

1. An appliance lid hinge assembly comprising:

a housing including first and second spaced-apart side walls and a transverse face wall;

a slot comprising first and second slot portions respectively located in said first and second side walls;

a cam arm adapted to be connected to an associated appliance body, said cam arm comprising a lobed edge, wherein the housing is pivotally connected to said cam arm via a pivot fastener at a pivot point; and a biasing element that acts between the housing and the cam in order to control the movement of housing relative to the cam about the pivot point, said biasing element comprising:

a spring rod slidably engaged with the housing and including a roller located adjacent an inner end, said roller engaged with and riding on the lobed edge of the cam arm such that said spring rod reciprocates relative to said housing in response to contact between said roller and said lobed edge;

a helical coil spring coaxially mounted about said spring arm and engaged between said housing and said spring arm and biasing said roller into contact with said lobed edge when said housing pivots relative to said cam arm for all positions of said housing when said housing pivots relative to said cam arm;

wherein the roller is connected to the spring rod by a fastener having opposite ends that are captured in said first and second slot portions located in said first and second side walls.

2. An appliance lid hinge assembly comprising:

a housing including first and second spaced-apart side walls and a transverse face wall;

first and second linear slot portions respectively located in said first and second side walls;

a cam arm adapted to be connected to an associated appliance body, said cam arm comprising a lobed edge, wherein the housing is pivotally connected to the cam arm via a pivot fastener at a pivot point; and a damper located between said first and second spaced-apart walls and comprising a body and a rod that extends and retracts relative to the damper body;

a roller connected to a first end of the damper and an opposite end of the damper connected to the housing;

wherein the roller is secured to said damper by a fastener that is slidably engaged with both the first and second slot portions such that said first and second slot portions constrain movement of the roller to a reciprocal linear path, and wherein pivoting movement of said housing relative to said cam arm in first and second directions results in reciprocal movement of said roller on said linear path in response to contact between said roller and said lobed edge of said cam arm.

3. The lid hinge assembly of claim 2, wherein the damper is a fluid damper.

4. The lid hinge assembly of claim 3, wherein the damper further includes an internal spring that biases the rod toward its extended position.

5. The lid hinge assembly of claim 3, wherein the damper further includes internal fluid pressure that biases the rod towards its extended position.

6. An appliance lid hinge assembly comprising:

a housing including first and second spaced-apart side walls and a transverse face wall, said housing adapted to be connected to an appliance lid;

first and second linear slot portions respectively located in said first and second side walls of said housing;

a cam arm adapted to be engaged with a mounting receptacle of an associated appliance body, said cam arm comprising a lobed edge and pivotally connected to said housing by a pivot fastener at a pivot point;

a slide body located between the first and second side walls of the housing and slidably connected to said housing, said slide body comprising a roller connected thereto and in contact with the lobed edge of the cam arm, the slide body adapted for reciprocal sliding movement relative to the housing toward and away from the pivot point during pivoting movement of the housing relative to the cam arm between a first position and a second position in response to contact between said roller and said lobed edge as said roller rolls on said lobed edge during said pivoting movement of the housing relative to the cam arm, wherein said roller contacts said lobed edge for all positions of said housing when said housing pivots to and between said first and second positions;

a biasing element operably located between the slide body and the housing and resiliently biasing the roller toward the lobed edge;

a snubber assembly connected to the housing in a location where the slide body is located between the snubber assembly and the pivot point, the snubber assembly comprising at least one snubber which is biased to an extended position and is selectively moveable to a retracted position against a damping resistance;

wherein the slide body contacts the snubber during movement of the slide body toward said snubber when the housing moves from a second position toward a first position and the slide body causes movement of the snubber from its extended position to its retracted position against the damping resistance such that the snubber dampens movement of the slide body away from the pivot point and damps movement of the housing toward its first position.

7. The lid hinge assembly as set forth in claim 6, wherein the slide body maintains continuous contact with the snubber for all positions of the housing between the first position and the second position.

8. The lid hinge assembly of claim 7, wherein said snubber comprises at least one snubber body connected to said housing and comprising a piston and piston rod, wherein the snubber body contacts the slide body for all positions of the housing between said first position and said second position, including the first position and the second position.

9. The lid hinge assembly as set forth in claim 8, wherein said snubber body comprises a cylinder containing hydraulic fluid and a spring damper within said cylinder.

10. The lid hinge assembly as set forth in claim 8, wherein said snubber assembly is configured to provide more damping resistance during movement of the piston from its extended position toward its retracted position as compared to movement of the piston from its retracted position toward its extended position.

11. The lid hinge assembly as set forth in claim 7, wherein the snubber assembly comprises a base that supports the at least one snubber, the at least one snubber comprising a piston rod connected to a piston and projecting outwardly from the base away from the pivot point, wherein the slide body contacts the snubber base for all positions of the housing between and including the first position and the second position.

12. The lid hinge assembly as set forth in claim 11, wherein said snubber assembly comprises first and second snubbers housed within said snubber base, said first and second snubbers each comprises a piston and rod wherein said first and second snubbers are each biased to an extended position and selectively moveable to a retracted position against a damping resistance.

13. The lid hinge assembly of claim 12, wherein each of said first and second snubbers comprises a cylinder containing hydraulic fluid and a spring damper within said cylinder.

14. The lid hinge assembly as set forth in claim 11, wherein said snubber comprises a cylinder containing hydraulic fluid and a spring damper within said cylinder.

15. The lid hinge assembly as set forth in claim 11, wherein said snubber assembly is configured to provide more damping resistance during movement of the piston from its extended position toward its retracted position as compared to movement of the piston from its retracted position toward its extended position.

16. The lid hinge assembly as set forth in claim 6, wherein said slide body comprises a spring rod and said spring comprises a helical coil spring through which said spring rod extends, wherein said spring is operatively positioned between said housing and said spring rod and biases said spring rod toward said first pivot point and biases said roller toward said lobed edge.

* * * * *